US005671766A

United States Patent [19]

Williams

[11] Patent Number: 5,671,766

[45] Date of Patent: Sep. 30, 1997

[54] PORTABLE, ADJUSTABLE TENT ASSEMBLY

[76] Inventor: Johnny R. Williams, 2931 NW. 158th St., Opaloca, Fla. 33054

[21] Appl. No.: 629,010

[22] Filed: Apr. 8, 1996

[51] Int. Cl.[6] ..... A45F 1/16

[52] U.S. Cl. ..... 135/121; 135/143; 135/144; 135/151; 135/157; 135/160; 135/114; 135/87

[58] Field of Search ..... 135/87, 97, 95, 135/121, 143, 144, 151, 157, 158, 160, 114, 115, 117

[56] References Cited

U.S. PATENT DOCUMENTS

| | | | |
|---|---|---|---|
| 514,726 | 2/1894 | Ormsby | 135/160 X |
| 1,900,335 | 3/1933 | Del Vecchio | 135/158 X |
| 2,575,572 | 11/1951 | Wickstrum | 135/158 X |
| 2,874,708 | 2/1959 | Daus, Jr. | 135/158 X |
| 2,936,771 | 5/1960 | Marchfield . | |
| 2,975,792 | 3/1961 | Herbert et al. | 135/158 X |
| 3,469,588 | 9/1969 | Rainwater . | |
| 3,848,279 | 11/1974 | Ipsen, Jr. . | |
| 4,077,418 | 3/1978 | Cohen | 135/143 X |
| 4,558,713 | 12/1985 | Hagler et al. | 135/159 |
| 4,706,551 | 11/1987 | Schofield | 135/117 X |
| 5,121,765 | 6/1992 | MacMorris, Jr. . | |
| 5,337,772 | 8/1994 | Habchi . | |
| 5,343,887 | 9/1994 | Danaher . | |
| 5,411,046 | 5/1995 | Wan . | |
| 5,584,311 | 12/1996 | Schaefer | 135/121 X |

*Primary Examiner*—Wynn E. Wood
*Attorney, Agent, or Firm*—Malloy & Malloy, P.A.

[57] ABSTRACT

A portable, adjustable tent assembly including a frame having first and a second opposite side sections, each having a plurality of individual support members hingedly secured with one another and structured to independently move between an extended and a collapsed orientation. Further, the tent assembly includes a primary and secondary roof panel, constructed of at least one flexible material sheet, and disposed in spanning relation between the primary and secondary horizontal supports of each side section, a front and rear wall panel extend respectively between spaced apart forward support members and spaced apart rear support members, and first and second side wall panels disposed correspondingly between the horizontal support members and the forward, central and rear support members. Each of the various panels being structured to define a corresponding portion of the tent assembly without restricting full collapsibility thereof wherein the fully collapsed opposite side sections generally abut one another. The frame is structured to be selectively adjustable between a storage orientation, a partially raised orientation, and a fully raised orientation, with the fully raised orientation defining a complete tent enclosure, the partially raised orientation defining a half tent enclosure, and the storage orientation defining a substantially compact, transportable unit.

28 Claims, 3 Drawing Sheets

PORTABLE, ADJUSTABLE TENT ASSEMBLY

BACKGROUND OF THE INVENTION

1. Field of the Invention

The present invention relates to a portable, adjustable tent assembly which can be easily and conveniently stored and transported to any location by a single person, and which is exceptionally quick and easy to assemble into a generally large, sturdy, functional tent enclosure without the use of any added tools or equipment.

2. Description of the Related Art

Tent enclosures are commonly used in a variety of circumstances so as to provide some shelter from the exterior elements. A primary advantage of tent enclosures over other, more rigid enclosures is the portability and storeability thereof. For example, with a tent an individual who may be hiking, or otherwise be in a remote location wherein a permanent structure is not available, is able to easily and conveniently carry the tent with them until a proper location for erecting the tent is found.

Generally, most conventional tents consist of a number of rigid supports along with a canvas or similar material type cover. A common difficulty associated with the use of a conventional tent enclosure, however, relates to the problems associated with assembling the tent at the remote location. In fact, it is a frequent occurrence that the generally complex and intricate nature of erecting a tent, and in particular, a larger multi-person tent having a number of individual parts, can make assembly quite difficult, and as a result quite time consuming. Specifically, most tent assemblies usually include a series of complex assembly instructions which designate the manner and order in which a variety of smaller, separate, portable sections are interlocked with one another. Generally, these sections, many of which look very similar to one another and are usually either bound or snapped together with one another, must fit together in a precise orientation and arrangement in order to properly define the tent enclosure. Moreover, once the tent is erected, there is no adjustability as to the size of the tent in case a larger or smaller tent enclosure becomes necessary.

In an attempt to overcome and alleviate the significant difficulties and inconveniences associated with erecting a conventional multi-person tent assembly, others have sought to develop automatically expanding tent assemblies. For example, some such tent assemblies include springs or coiled type frame structures which can be collapsed, thereby making the structure transportable, and once released, the normal biasing force of the frame pops the tent into its effective shape. Naturally, such devices have become quite popular due to their ease of erection, however, they do have some significant limitation associated with their use.

The major limitation associated with the use of pop-up type tents relates to the limited size of the enclosure. Specifically, such automatically erecting tent enclosures are generally single person tents, conveniently useable only for sleeping purposes. As such, the smaller tents have limited functionality, are not effective to providing shelter from the elements while still allowing individuals to interact or perform various activities, and can generally not be effectively utilized in alternative circumstances such as, for multi-person use, during parties and at craft shows. Moreover, the physical properties of such small tents which makes them easy to erect, makes it substantially unpractical to make a larger version, as that size increase would significantly reduce their portability, and also makes it quite difficult to collapse the tent for storage, as an individual must fight against the tent frames natural expanding tendencies in order to perform the precise folding and collapsing maneuvers required to fully collapse the tent.

As such, there is still a substantial need in the art for a portable and adjustable tent assembly which: can be effectively utilized by more than one person; can be easily and conveniently adapted to varying sizes, depending upon a user's needs; does not require complex assembly instructions; can be quickly and easily collapsed as well as erected; and is substantially compact and transportable when being brought to or taken away from a particular site in which it will be raised. Such an improved tent assembly should be strong and durable, installation quite rapid, and should be adaptable for a variety of single and multi-person uses.

SUMMARY OF THE INVENTION

The present invention is directed towards a portable, adjustable tent assembly which can be quickly and easily raised for use by one or more persons. In particular, the portable, adjustable tent assembly includes a generally strong, light weight frame having a first opposite side section and a second side opposite section. Each of the opposite side sections is generally similarly configured so as to define the respective sides of the tent.

Each of the opposite side sections includes a primary horizontal support member. The primary horizontal support member, which is generally rigid, includes a forward end and a rear end. Further, each opposite side section includes a forward support member. The forward support member, which includes a bottom end and a top end is structured to be hingedly secured at generally the forward end of the primary horizontal support member. As such, the forward support member is able to pivotally move between an extended orientation and a collapsed orientation. In particular, the extended orientation of the forward support member includes the forward support member disposed in a generally vertical orientation relative to an underlying support surface, while conversely, the collapsed orientation of the forward support member includes the forward support member folded into generally collapsed, parallel relation with the primary horizontal support member.

Also included with each of the opposite side sections is a central support member. Specifically, the central support member includes a bottom end and a top end. The top end of the central support member is structured to be hingedly secured at generally the rear end of the primary horizontal support member, thereby permitting pivotal movement of the central support member between an extended orientation and a collapsed orientation. Specifically, the extended orientation of the central support member includes the central support member generally vertically disposed towards the underlying support surface, whereas the collapsed orientation includes the central support member folded into generally collapsed, parallel relation with the primary horizontal support member.

Structured to be hingedly secured to the rear end of the primary horizontal support member of each of the opposite side sections is a secondary horizontal support member. The secondary horizontal support member includes a front end and a rear end, with the front end being hingedly secured at the rear end of the primary horizontal support member in order to permit pivotal movement of the secondary horizontal support member between an extended orientation and a collapsed orientation. When in its extended orientation, the secondary horizontal member is disposed in a generally horizontal orientation, extending away from the rear end of the primary horizontal support member. When in its collapsed orientation, however, the secondary horizontal support member is folded into generally collapsed, parallel relation with the primary support member.

Further, the first and second opposite side sections include a rear support member. The rear support member, which includes a bottom end and a top end, is structured to be hingedly secured to the rear end of the secondary horizontal support member at its top end. As such, the rear support member is also pivotally movable between an extended orientation and a collapsed orientation. The extended orientation of the rear support member includes the rear support member generally vertically disposed relative to the underlying support surface when the secondary horizontal support is also disposed in its extended orientation. The collapsed orientation, however, includes the rear support member folded into generally collapsed, parallel relation with the secondary horizontal support member.

The portable, adjustable tent assembly of the present invention further includes a primary roof panel. The primary roof panel, which is constructed of at least one flexible material sheet, is structured to be disposed in spanning relation between the primary horizontal support members of both the first and second opposite side sections. Furthermore, the primary roof panel functions to define a primary roof portion when the first and second opposite side sections are disposed a spaced apart distance from one another. Still, however, a structure of the primary roof panel is such that it will permit the primary horizontal support members of the first and second opposite side sections to be collapsed or rolled into adjacent, generally abutting relation with one another when necessary.

Similarly, disposed in spanning relation between the secondary horizontal support members of the first and second opposite section is a secondary roof panel. The secondary roof panel, which is also constructed of at least one flexible material sheet is structured to define a secondary roof portion upon the first and second opposite side sections being disposed in the spaced apart distance from one another and upon the secondary horizontal support members of both the first and second opposite side sections being disposed in their respective extended orientations. Much like the primary roof panel, however, the secondary roof panel is structured to permit the secondary horizontal support members of both the first and second opposite side sections to be collapsible into adjacent, generally abutting relation with one another.

Additionally, the portable, adjustable tent assembly of the present invention includes a front wall panel and a rear wall panel. Looking first to the front wall panel, it is constructed of at least one flexible material sheet and is structured to extend between the forward support members of the first and second opposite side sections. The front wall panel defines a front wall portion upon the first and second opposite side sections being disposed their spaced apart distance from one another and upon the forward support members being disposed in their extended orientations. Similarly, the rear wall panel, which is constructed of at least one flexible material sheet, is structured to extend between the rear support members of the first and second opposite side sections. The rear wall panel defines a rear wall portion upon the first and second opposite side sections being disposed in their generally spaced apart distance from one another, the rear support members of the first and second opposite side sections being disposed in their extended orientations, and the secondary horizontal supports being disposed in their extended orientations. Additionally, both the front and rear wall panels are structured so as to permit the first and second opposite side sections to be collapsible into adjacent, generally abutting relation with one another.

In order to define a pair of opposite primary side walls and a pair of opposite secondary side walls, the portable, adjustable tent assembly further includes a first and a second primary side wall panel, as well as first and a second secondary side wall panel. Specifically, the first and second primary side wall panels are constructed of at least one flexible material sheet and are structured to be disposed between the primary horizontal support members, the forward support members, and the central support members of the first and second opposite side sections, thereby defining the pair of opposite primary side walls. Similarly, the first and second secondary side wall panels are constructed of at least one flexible material sheet and are structured to be disposed between the secondary horizontal support member, the central support member, and the rear support member of both the first and second opposite side sections, thereby defining a pair of opposite secondary side walls.

Finally, it is seen that the frame, and in particular the first and second opposite sections, are adjustably positionable between a storage orientation, a partially raised orientation, and a fully raised orientation. In the fully raised orientation, the first and second opposite side sections are disposed a spaced apart distance from one another. Further, in the fully raised orientation the forward and central support members are disposed in their respective extended orientations, such that the bottom ends thereof supportingly engage the underlying support surface, and the secondary horizontal support member and the rear support member are disposed in their respective extended orientations, such that the bottom end of the rear support members supportingly engage the underlying support surface. Accordingly, in the fully raised orientation a complete tent inclosure is defined.

Turning to the partially raised orientation, it includes the first and second opposite side sections disposed in the spaced apart distance from one another, as well as the forward and central support members disposed in their respective extended orientations so that their bottom ends engage the underlying support surface. In the partially raised orientation, however, the secondary horizontal support member and the rear support member are disposed in their respective collapsed orientation, thereby only defining a half tent enclosure.

Lastly, the storage orientation includes the secondary horizontal support members, as well as the forward, central and rear support members disposed in their respective collapsed orientations. Further, in the storage orientation the first and second opposite side sections are disposed in adjacent, generally abutting relation with one another, thereby defining a substantially compact, transportable unit.

It is an object of the present invention to provide a portable, adjustable tent assembly which can be easily and conveniently be transported and carried to various locations.

Another object of the present invention is to provide a portable, adjustable tent assembly which can be raised very easily and quickly, without requiring complex and detailed interconnections be made or complex instructions be provided.

Also an object of the present invention is to provide a tent assembly which can be adjustably sized conveniently and easily.

A further object of the present invention is to provide a tent assembly which is sufficiently large to contain multiple persons.

Yet another object of the present invention is to provide a tent assembly which can be conveniently and effectively utilized in non-camping circumstances, such as at a party or outdoor craft show.

A further object of the present invention is to provide a tent assembly which is substantially lightweight and easy to transport, yet is substantially strong.

Also an object of the present invention is to provide a tent assembly which does not require a user to completely install the material covering of the tent assembly over its frame.

Another object of the present invention is to provide a tent assembly which in addition to being easily raised, is substantially simple and easy to collapse.

An additional object of the present invention is to provide a tent assembly which provides a sufficient interior work area to permit the accomplishment of various single and multi-person tasks therein in addition to sleeping.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
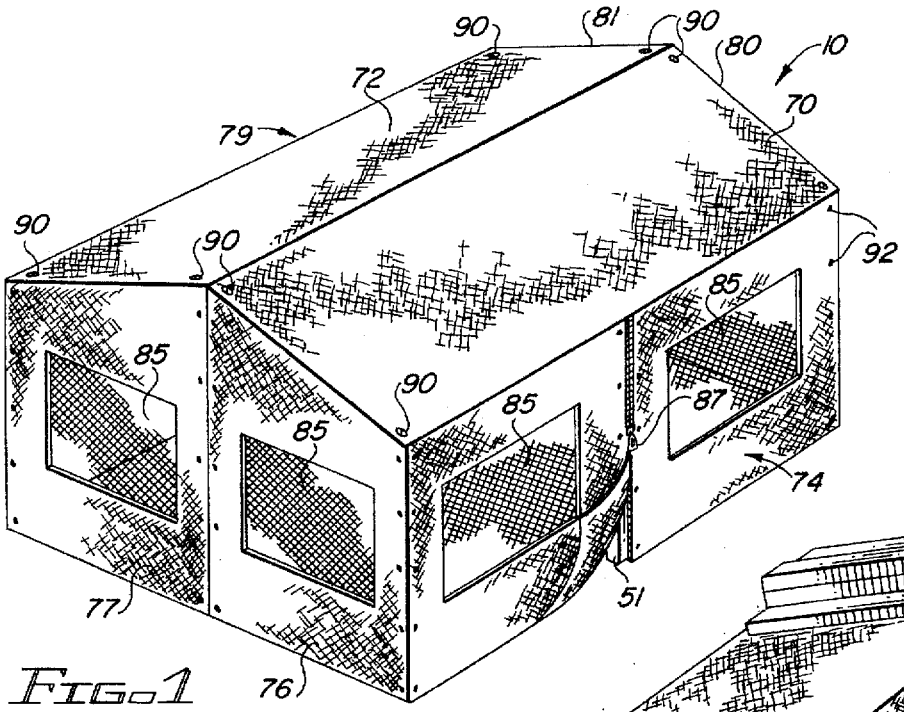
FIG. 1 is an elevated perspective view of the portable, adjustable tent assembly of the present invention in its fully raised orientation.

Shown throughout the Figures, the present invention is directed towards a portable, adjustable tent assembly, generally indicated as 10. The tent assembly 10 is primarily structured to facilitate transportability as well as rapid, uncomplicated, sturdy erection and disassembly thereof in a desired location, while providing room for one or more individuals to conduct a variety of single or multiperson activities.

Turning specifically to the structure of the portable, adjustable tent assembly 10, it includes a frame 20 that defines the general overall shape and structure of the tent assembly 10. For purposes of illustration, the frame 20 can be divided into a first opposite side section and a second opposite side section, which in essence preferably define a left and a right side of the frame. Furthermore, so as to provide substantial symmetry in the overall tent assembly 10, it is preferred that the first and second opposite sections be substantially similar in structure. Looking further to the frame 20, as best illustrated in FIGS. 4 A–C, each of the opposite side sections includes a primary horizontal support member 22 and 22'. The primary horizontal support members 22 and 22' each include a forward end 23 and 23' and a rear end 24 and 24', and are preferably generally elongate as they generally define a length of a primary roof portion of the tent assembly 10. Further, each of the opposite side sections includes a forward support member 28 and 28'. The forward support members 28 and 28' each preferably include a top end 29 and 29' and a bottom end 30 and 30', and are structured to be hingedly secured to a corresponding primary horizontal support member 23 and 23'. Preferably, the top end 29 and 29' of the forward support member 28 and 28' is secured at generally the forward end 23 and 23' of the primary horizontal support member 22, with a hinge 60, thereby permitting the forward support members 28 and 28' to pivot between an extended orientation and a collapsed orientation. In the extended orientation, the forward support members 28 and 28' are generally vertically disposed relative to an underlying support surface. Furthermore, it is preferred that the top end 29 and 29' of the forward support members 28 and 28' be secured directly to the primary horizontal support members 22 and 22', but slightly inward from the front end 23 and 23' of the primary horizontal support members 22 and 22' such that when the forward support members 28 and 28' are disposed in their extended orientation the forward ends 23 and 23' of the primary horizontal support members 22 and 22' rest atop the forward support members 28 and 28' and achieve a sturdier support than could be achieved merely with the hinge 60. Alternatively, in its collapsed orientation the forward support member 28 and 28' is folded into generally collapsed, parallel relation with the primary horizontal support member 22 and 22', and in particular an underside thereof.

Further included in both the first and second opposite side sections of the frame 20 is a central support member 31 and 31' member. The central support members 31 and 31', which includes a bottom end 33 and 33' and a top end 32 and 32' are structured to be hingedly secured at generally the rear end 24 and 24' of the primary horizontal support member 22 and 22'. Much like the forward support member, the central support member is also structured to pivotally move between an extended orientation and a collapsed orientation. In its extended orientation, the central support members 31 and 31' are generally vertically disposed relative to the underlying support surface so as to supportably bear the rear end 24 and 24' of the primary support members 22 and 22' thereon. Also, like the forward support members 28 and 28' the central support members 31 and 31' can be hingedly secured slightly inward of the rear end 24 and 24' of the primary support members 22 and 22' so as to achieve further supportability at its upper surface.

Figure 3:
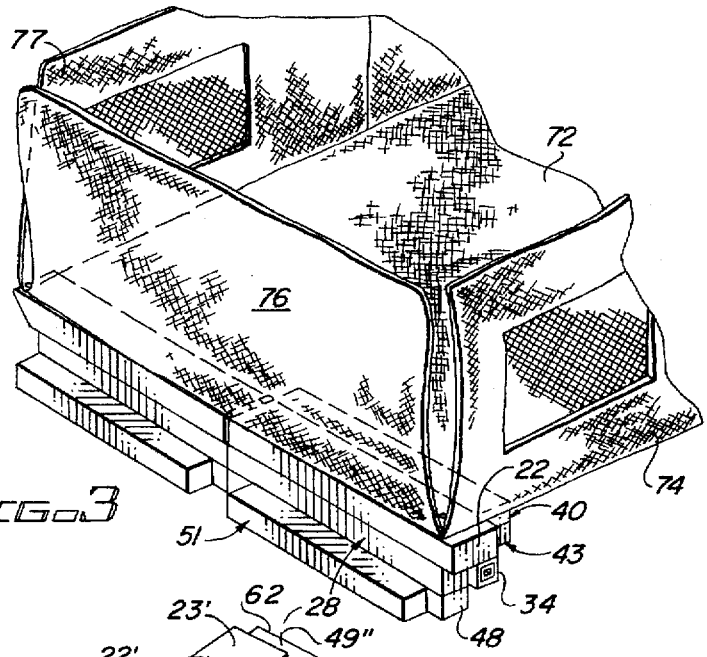
FIG. 3 is a partial perspective view of the portable, adjustable tent assembly of the present invention illustrating its collapsibility into the storage orientation.

Extending from the rear end 24 and 24' of each of the primary horizontal support members 22 and 22', is a secondary horizontal support member 25 and 25'. Specifically, the secondary horizontal support members 25 and 25' preferably have a substantially equivalent configuration to that of the primary horizontal support members 22 and 22', and include a front end 26 and 26' and a rear end 27 and 27'. It is the front end 26 and 26' of the secondary horizontal support members 25 and 25' that is hingedly secured to the rear end 24 and 24' of the primary horizontal support members 22 and 22' so that the secondary horizontal support members 25 and 25' are able to pivot between an extended orientation and a collapsed orientation. In the extended orientation, the secondary horizontal support member 25 and 25' is disposed in a generally horizontal orientation extending away from the rear end 24 and 24' of the primary horizontal support members 22 and 22' such that the front ends 26 and 26' thereof generally abut the rear ends 24 and 24' of the primary horizontal support members 22 and 22'. Conversely, in the collapsed orientation, the secondary horizontal support members 25 and 25' are structured to be folded into a generally collapsed, parallel relation with the primary horizontal support members 22 and 22', and preferably will overlie a top surface of the primary horizontal support member 22 and 22', as best seen in FIG. 3.

Hingedly secured to the rear end 27 and 27' of each of the secondary horizontal support members 25 and 25' is a rear support member 35 and 35'. The rear support members 35 and 35' include a top end 36 and 36' and a bottom end 37 and 37', with the top end 36 and 36' being secured at generally the rear end 27 and 27' of the secondary horizontal support members 25 and 25'. The rear support members 35 and 35' will also preferably be secured somewhat inward of the rear end 27 and 27' of the secondary horizontal support members 25 and 25' so as to achieve greater supportability of the secondary horizontal support members 25 and 25' thereon. In this regard, it is also seen that the central support members 31 and 31' are preferably disposed such that they can supportably hold both the rear end 24 and 24' of the primary horizontal support members 22 and 22' thereon, as well as the front end 26 and 26' of the secondary horizontal support members 25 and 25'. As a result, both the primary and secondary horizontal support members 22, 22', 25 and 25' are all preferably supportably retained atop of the forward, central, and rear support members, 28, 28', 31, 31', 35 and 35'. It is understood, however, that a sufficiently strong hinge 60 may also be included at the various interconnections, that hinge 60 being structured to maintain the various support members of the frame 20 within their extended orientations in a substantially strong, stable configuration. Also, any other hinge type interconnection that permits relative movement of the various members could be effectively utilized.

Figure 4A:
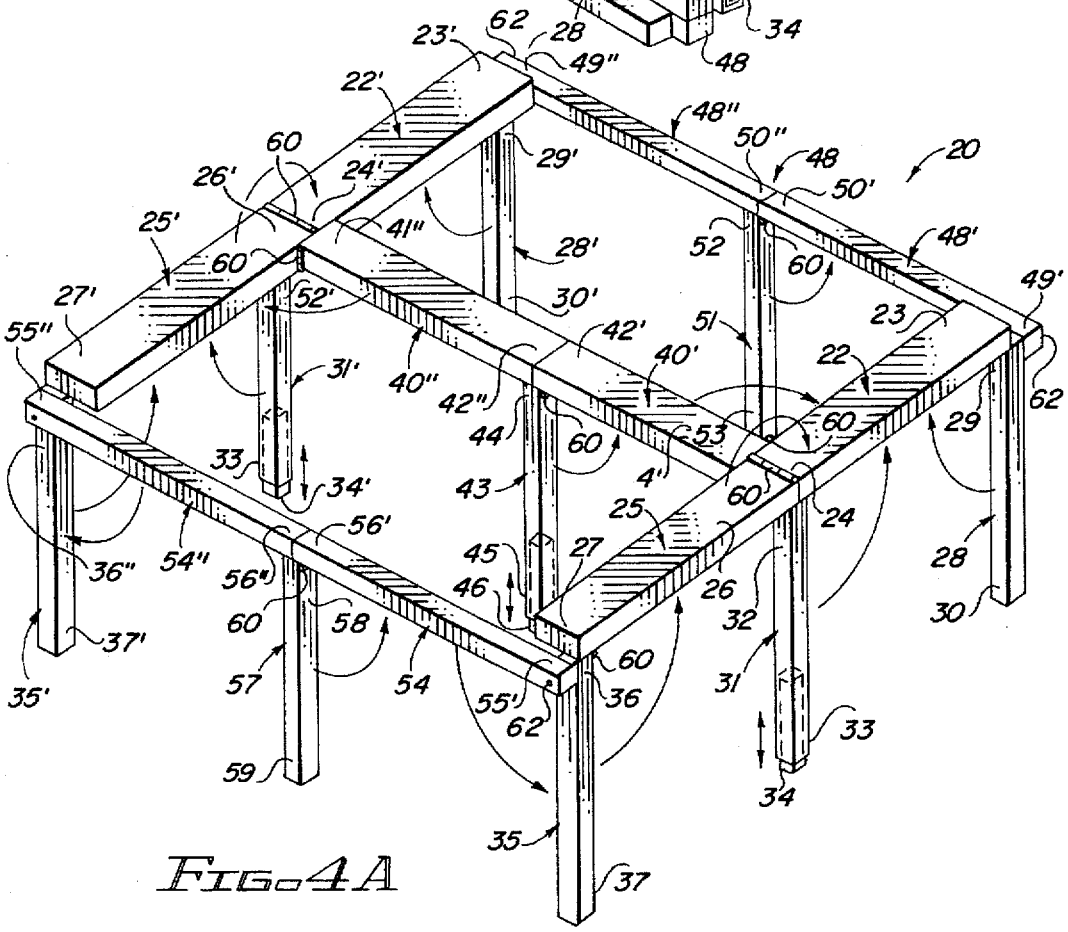
FIG. 4A is a perspective view of a preferred embodiment of the frame of the portable, adjustable tent assembly of the present invention.
Figure 4B:
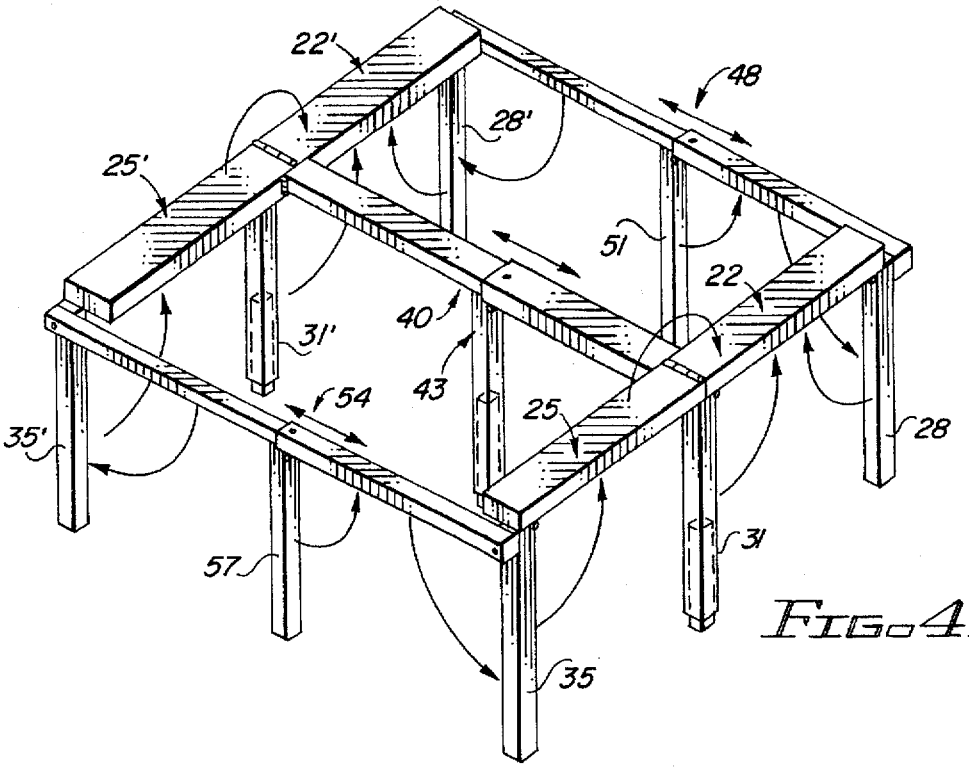
FIG. 4B is a perspective view of an alternative embodiment of the frame of the portable, adjustable tent assembly of the present invention.
Figure 4C:
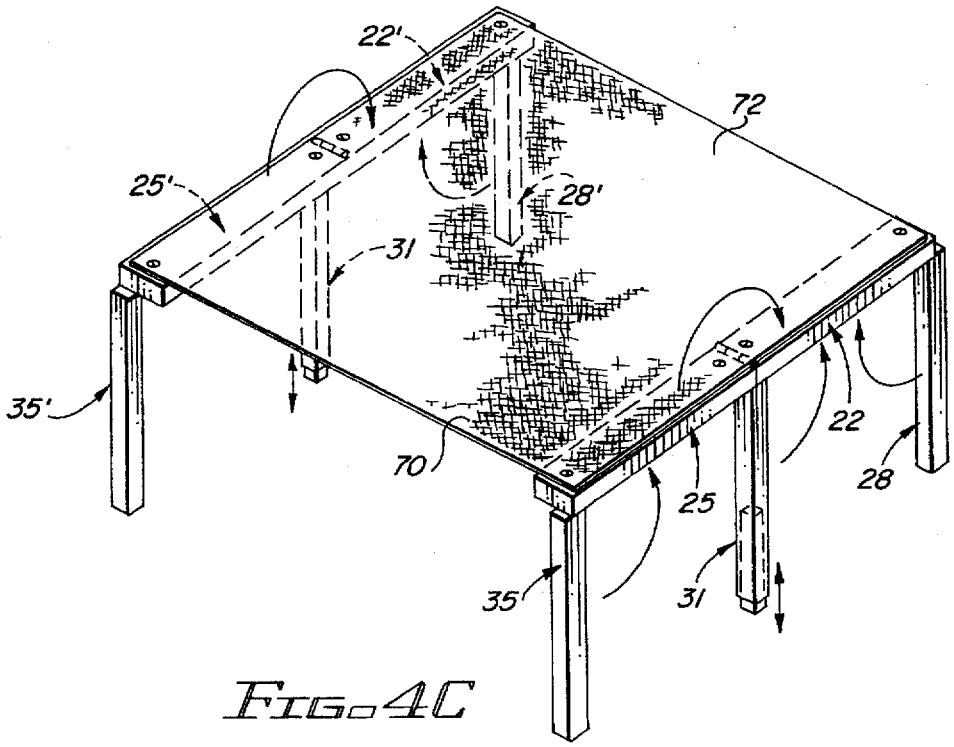
FIG. 4C is a perspective view of another alternative embodiment of the frame of the portable, adjustable tent assembly of the present invention.

Although the previously recited structural support members are generally sufficient to define a strong and effective frame 20, as illustrated in FIG. 4C, in the preferred embodiments of the invention, as illustrated in FIGS. 4A and 4B, the frame 20 may also include a plurality of spanning support members 40, 48 and 54. Specifically, the spanning support members 40, 48 and 54 extend between the opposite side sections and thereby affirmatively maintain the opposite side sections spaced apart from one another and provide further structural support for a roof. As such, in these embodiments, the frame 20 includes a central spanning support member 40 extending between the first and second opposite side sections, at generally the rear end 24 and 24' of the primary horizontal support 22 and 22' and thereby maintain the opposite side sections in their spaced apart relation from one another. In a first preferred embodiment, shown in FIG. 4A, the central spanning support includes a pair of central span sections 40' and 40". Each of the central span sections 40' and 40" are hingedly secured to a corresponding one of the primary horizontal support members 22 and 22' and are movable between an extended orientation and a collapsed orientation. Also, it is preferred that the central span sections 40 and 40' be hingedly mounted to the primary horizontal support members 22 and 22' such that they overlap partially onto the secondary horizontal support members 25 and 25' when all are disposed in their extended orientation. It can therefore be seen that in their extended orientation, the central span sections 40 and 40' will generally abut one another, and may preferably be secured with one another so as to define the overall central spanning support. Furthermore, an optional auxiliary support 43, which includes a top end 44 and a bottom end 45 may also be included and may be hingedly secured to the central span section 40' at a free end 42' which is opposite the contact end 41' that abuts the horizontal support members 22 and 25. Also this auxiliary support 43 will preferably overlap partially onto the end 42" of the other central span section 40".

While in most circumstances only the central spanning support member 40 is required to provide a stronger frame 20, it is also seen that a forward spanning support 48 and rear spanning support 54 may be equivalently included. As illustrated in the embodiment of FIG. 4A, the forward spanning support member 48 may include a pair of forward span sections 48' and 48" which are pivotally secured at generally the front end 23 and 23' of the primary horizontal support members 22 and 22', but preferably directly to a top end 29 and 29' of the forward support members 28 and 28'. Unlike a majority of the hinged interconnections of the frame 20 wherein a standard piano type hinge 60 is incorporated, it is preferred that an axial pivot rod 62 be included and extend through the forward span sections 48' and 48" at their first ends 49' and 49" into the forward support members, at generally their top ends 29 and 29'. As such, when in an extended orientation the forward span sections 48' and 48" will generally abut one another at their free ends 50' and 50", and may in fact be secured with one another unless an auxiliary support 51 is included and hingedly secured to the free end 50' of one of the forward span sections 48' so that the top end 52 of the auxiliary support 51 supports both of the forward span sections 48' and 48", and the bottom end 53 of the auxiliary support 51 engages the underlying support surface. Also, given the pivotal interconnection between the forward span sections 48' and 48" and the forward support members 28 and 28', when the forward span sections 48' and 48" are pivoted into their collapsed orientations they will be generally aligned with a front face of the forward support members 28 and 28' and can be readily collapsed beneath the primary horizontal support members 22 and 22' upon pivotal movement of the forward support members 28 and 28' into their collapsed orientation.

Much like the forward spanning support 48, a rear spanning support 54 is included wherein in the embodiment of FIG. 4A a pair of rear span sections 54' and 54" are included. From this it can be seen that the rear span sections 54' and 54" are generally equivalently configured as the forward span sections 48' and 48" with a first end 55' and 55" thereof pivotally secured to the generally the top end 36 and 36' of the rear support members 35 and 35' and the free ends 56' and 56" generally abutting one another and being secured with one another or alternatively supportably held by an auxiliary support 57 hingedly secured at its top end 58 to one of the rear spanning sections 54'.

Looking to FIG. 4B, it an alternative embodiment wherein the spanning supports are included, each of the spanning supports 40, 48 and 54 may include a single telescoping member 40'", 48'" and 54'" pivotally secured to one of the corresponding support members and including an extended orientation wherein a length of the single telescoping member 40", 48" and 54" is increased until is can extend into secured spanning engagement with an opposite one of the support members. Similarly, upon being positioned in its collapsed, retracted orientation, the spanning supports 40", 48" and 54" are structured to retract and pivot into aligned orientation with the corresponding support members.

In addition to the frame 20, the tent assembly 10 of the present invention further includes a plurality of material panels which define the roof and walls of the tent assembly 10. These material panels, which are preferably formed of a canvas or other lightweight, durable, weather resistant material are structured to provide a containment for an interior of the tent assembly 10 and thereby define the tent enclosure. In particular, the present invention includes a primary roof panel 70 constructed of at least one flexible material sheet and disposed in spanning relation over the primary horizontal support members 22 and 22'. The primary roof panel 70 is structured to define a primary roof portion of the tent assembly 10 upon the first and second opposite side sections being disposed a spaced apart distance from one another. Still, however, the primary roof panel 70 is configured so as to permit the primary horizontal support members 22 and 22' of the first and second opposite side sections to be collapsible into generally adjacent, generally abutting relation with one another.

Similarly, the present invention further includes a secondary roof panel 72. The secondary roof panel is also constructed of at least one flexible material sheet, and in fact in the preferred embodiment both the primary and secondary roof panels 70 and 72 are formed of a single large material sheet. The secondary roof panel 72 is seen to span the secondary horizontal support members 25 and 25' of the opposite side sections and thereby define a secondary roof portion when the first and second opposite side sections are disposed the spaced apart distance from one another and when the secondary horizontal support members 25 and 25' are disposed in their extended orientations. As with the primary roof panel 70, the secondary roof panel 72 is structured to permit the secondary horizontal support members 25 and 25' to be collapsible into adjacent, generally abutting relation with one another when necessary.

So as to define the various walls of the tent assembly 10, the present invention includes a front wall panel 74. The front wall panel 74 is constructed of at least one flexible material sheet and is structured to extend between the forward support members 28 and 28', and in the embodiments of FIGS. 4A and 4B between the forward support members 28 and 28' and the forward span support 48. As such, the front wall panel 74 can define a front wall portion when the first and second opposite side sections are disposed the space apart distance from one another and the forward support members 28 and 28' are disposed in their extended orientations. Similarly, a rear wall panel 79 is included, and preferably constructed from at least one flexible material sheet, the rear wall panel 79 being structured to extend between the rear support members 35 and 35' so as to define a rear wall portion when the opposite side sections are disposed in a space apart distance from one another and the rear and secondary horizontal support members are disposed in their extended orientations.

So as to define the sides of the tent assembly 10, it is preferred that a first and a second primary side wall panels 76 and 80, as well as a first and a second secondary side wall panels 77 and 81 be included and each constructed of at least one flexible material sheet. The first and second primary side wall panels 76 and 80 are structured to be disposed between the primary horizontal support members 22 and 22', and their respective forward and central support members 28 and 28' and 31 and 31' thereby defining a pair of opposite primary side walls. Similarly, the first and second secondary side wall panels 77 and 81 are structured to be disposed between the secondary horizontal support members 25 and 25' and their corresponding central support members 31 and 31' and rear support members 35 and 35' in order to define a pair of opposite secondary side walls.

From the previous description, and as illustrated throughout the Figures, it should be noted that the various roof and wall panels may in fact be constructed of a single, large material sheet having a plurality of properly positioned seams or slits to permit the panels to collapse onto one another and especially onto the roof panel portions, as well as be expanded into secure engagement over the frame 20 in order to define a corresponding panel to cover the frame 20. In this regard, it is preferred that the primary and secondary roof panels 70 and 72 be fixedly secured to the primary and secondary horizontal support members 22 and 22', 25 and 25', such as by a plurality of rivets or bolts 90, but however that the remaining panel portions be removably securable to the various corresponding support members, such as through a plurality of snaps 92 or utilizing any other conventionally fastener such as hook and loop fastener pads, straps, magnets and the like. Moreover, some panel portions may be configured to retract into an interior of a corresponding support member so as to be pulled out into an extended position when needed to cover the frame portion. Additionally, so as to provide for convenient entry and exit into the tent enclosure defined within the frame 20, any of the various wall panels, but preferably the front or rear wall panels 74 and 79 will also include a resealable seam 87 defined therein and structured to permit facilitated entry therethrough, while also permitting effective closure from both the inside and the outside to provide privacy, protection and the like. In this regard, it is preferred that the resealable seam 87 include a zipper although buckles, snaps, or merely an overlying flap may be acceptably implemented. Furthermore, to provide for some comfort and convenience within the tent assembly 10 a plurality of windows 85 may be defined in any of the various panels, depending upon the visibility needs of the user.

Figure 2:
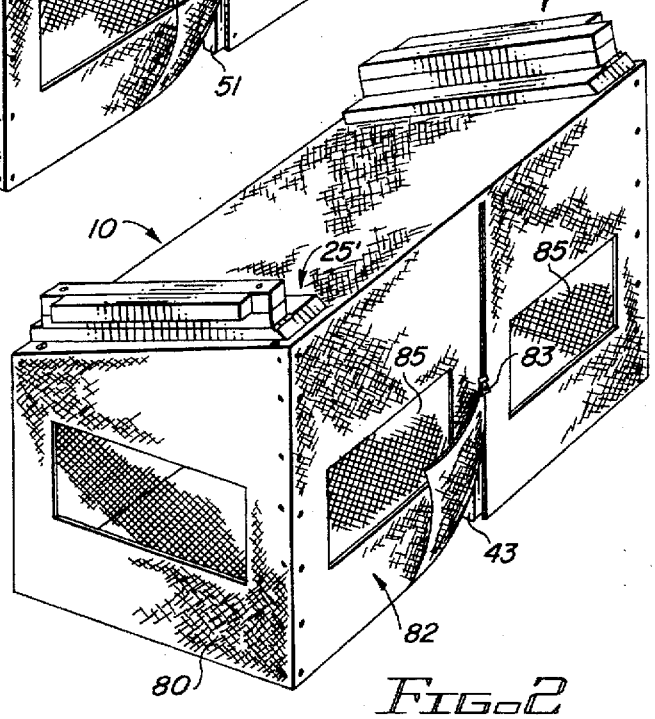
FIG. 2 is an elevated, reverse angle, perspective view of the portable, adjustable tent assembly of the present invention in its partially raised orientation.
Figure 5:
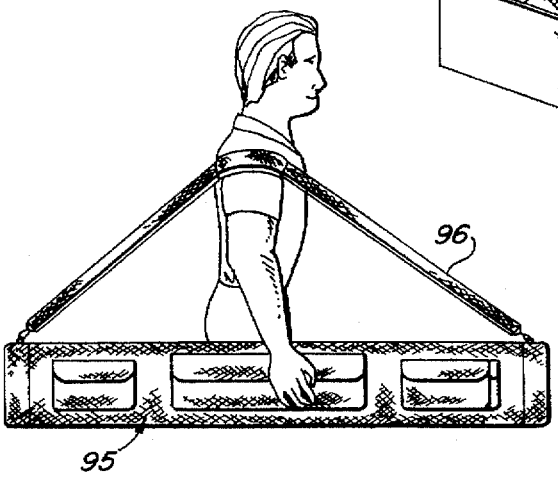
FIG. 5 is a perspective view illustrating the carry case and portability of the present invention.

Referring now to FIGS. 1, 2 and 3, it is seen that the present invention, and in particular as defined by the frame 20 of the present invention, is adjustable so as to define a storage orientation, a partially raised orientation, and a fully raised orientation. Looking first to the fully raised orientation of FIG. 1, it is seen that in order to achieve the fully raised orientation, the first and second opposite side sections of the frame 20 are disposed in their maximum spaced apart distance from another, as defined either by the spanning supports or as limited by the dimensions of the primary and secondary roof panels 70 and 72. Additionally, in the fully raised orientation the forward, central, rear, and secondary horizontal support members are all disposed in their respective extended orientations so the bottom ends of the forward, central, and rear support members engage the underlying support surface to support the remaining structure, and such that the primary and secondary horizontal support members define a roof of the tent assembly 10. In this regard, as in many instances a cantilevered type of roof is desirable, in a preferred embodiment the central support members 31 and 31', as well as the auxiliary support 43, if included, will all include a telescoping extension segment 34, 34' and 46, which extends therefrom and can extend the central support members 31 and 31' and auxiliary support 43 to an increased length. Of course, in such an embodiment it will be seen that the various support members may include tapered or chamfered ends so as to permit the freedom of motion necessary to provide the cantilevered roof configuration. Additionally, in this cantilevered configuration it is preferred that both the primary and secondary roof panels 70 and 72 be formed of a single material sheet as that will prevent leakage between an interconnection thereof.

In addition to the fully raised orientation of FIG. 1 which defines a complete tent enclosure, the present invention is also adaptable so as to be disposed in a partially raised orientation which defines only a half tent enclosure. Specifically, the partially raised orientation, as in FIG. 2, is especially beneficial in circumstances where a larger enclosure is not necessary, yet provides the benefit of not requiring an additional different size tent be made available to achieve the adjustable effect. In this partially raised orientation, the first and second opposite side sections of the frame 20 are disposed in their spaced apart relation from one another, and the forward and central support members 28 and 28', 31 and 31' are disposed in their respective extended orientations such that their bottom ends supportingly engage the underlying support surface. In the partially raised orientation, however, the rear support members 35 and 35' are disposed in their respective collapsed orientation relative to the secondary horizontal support members 25 and 25', and the secondary horizontal support members 25 and 25' are also disposed in their collapsed orientation. As can be seen in FIG. 2, therefore, the secondary horizontal support members 25 and 25', as well as the remaining support members which collapse therewith are disposed on an upper surface of the primary horizontal support members 22 and 22' in an out of the way location. Additionally, in this partially raised orientation the various panels which make up the secondary side walls 77 and 81, rear wall panel 79 and secondary roof panel 72 may also be equivalently collapsed and folded onto the primary roof panel 70, if integrally formed therewith, or may be detached if separately formed. Moreover, in the partially raised orientation it is seen that a center wall panel 82 is also preferably included and defined from at least one flexible material sheet. The center wall panel 82 extends between the center support members 31 and 31', thereby defining a central wall portion when the first and second opposite side sections are disposed their spaced apart distance from one another and the center support members are disposed in their extended orientations. In this regard, it can be seen that the center wall panel 82 may be included, regardless of whether the fully or partially raised orientations are implemented, wherein if the fully raised orientation is implemented the center wall panel 82 functions as a partition between portions of the tent enclosure. Also, as with the remaining wall panels, the central wall panel may include a plurality of windows 85 and a resealable seam 83 to permit entry and exit therethrough.

Lastly, the tent assembly 10 of the present invention includes a storage orientation wherein the secondary horizontal support members, the forward, central, and rear support members are all disposed in their relative collapsed orientations. Further, if the spanning support members and auxiliary supports are included, they will also be disposed in their collapsed orientations such that all of the various support members are disposed in substantially adjacent, generally abutting relation with one another and can define a substantially compact, transportable unit.

Looking to FIGS. 3 and 4A, the collapsing of the frame 20 can be defined. In the preferred embodiment, wherein the variety of additional supports are utilized, first the various telescoping segments 34, 34' and 46 are retracted into the corresponding central support members 31 and 31' and auxiliary support 43. Next, any locked or latched interconnections between the various adjacent support segments members that may be included are removed or detached. At that point, the various auxiliary supports 43, 51, 57 are hingedly pivoted into abutting engagement within an underside of spanning support sections 40, 48 and 54. The central spanning support sections 40 and 40' are then hingedly pivoted into abutting engagement with a side of the primary horizontal support members 22 and 22' followed by pivotal movement of the forward and rear span sections 48', 48" 54' and 54" into pivotal abutting engagement with a corresponding face of the corresponding forward and rear support members 28, 28', 35 and 35'. The rear support members 35 and 35' may be folded up into their collapsed orientation wherein they abut an underside of the secondary horizontal support members 35 and 35'. Next, the central and forward support members 31 and 31', 28 and 28' are folded into their collapsed orientation at the underside of the primary horizontal support member 22 and 22'. In this regard, it is seen that the primary horizontal support members 22 and 22' will have a width generally double that of the forward and center support members 28, 28', 31 and 31' such that both may collapse onto the underside of the primary horizontal support members 22 and 22' in a generally side by side configuration. Finally, the secondary horizontal support members 25 and 25' are folded onto a top surface of the primary horizontal support members 22 and 22'. It is noted that throughout collapsing of the various portions of the frame 20, the various panel portions may either be removed or may be collapsed on one another, as illustrated in FIG. 3. Once both of the opposite side sections of the frame 20 are disposed in their fully collapsed orientations, the entire assembly may be rolled or folded such that both the first and second opposite side sections come together into generally abutting engagement with one another and define the substantially compact transportable assembly. In this regard it can be seen that an additional carry case 95 may be included to contain the tent assembly 10 in its storage orientation so that through the use of handle or convent strap 96 a person may easily tote the entire assembly to the desired location.

In order to achieve maximum collapsibility and effectiveness of the assembly, it is preferred that all of the various support members include generally equivalent configurations, and all preferably be approximately five feet in length. It should be seen, however, that the primary horizontal support members 22 and 22' are preferably at least as long, if not longer than the remaining support members as the remaining support members must collapse onto the primary horizontal support members 22 and 22' and convenience dictates that they not be of greater lengths. Moreover, by making all of the supports of generally equivalent configurations a more compact assembly is defined, and by including the various support members at generally five feet, with the additional foot to foot and a half, telescoping segments 34, 34' and 46, the tent enclosure which is defined will have an interior height extending from five to six feet at its apex, with a width of approximately ten feet and a depth of five or ten feet, depending on whether the fully or partially raised orientations are implemented. Moreover, a plurality of lock pins or locking/ratcheted hinges may be implemented such that when the various support members are disposed in their extended orientations they remain secured in placed unless affirmatively released and permitted to return to their collapsed orientations. Such a configuration will help maintain the overall structural integrity of the tent assembly. As to the support members themselves, it is seen that they are preferably formed of a strong tubular configuration in order to minimize weight and not sacrifice strength, and may be round or preferably rectangular. Also, any strong rigid material such as aluminum or a strong plastic may be implemented. Further, engagement of the tent assembly 10 with the underlying support surface may be achieved in any conventional manner such as using a plurality of spikes extending from the support members, or including wider support feet which can be introduced into the support members. In a preferred embodiment illustrated in FIG. 4B, a plurality of hinged support feet 89 may be secured to one or more of the vertically disposed supports. These support feet 89 can easily and hingedly retract during storage, and when extended can be used in cooperation with a spike or like fastener secured thereto, such as through a preformed aperture. As to a floor covering, which is generally included in most conventional tents, an integral or separate floor panel may be included. In the cases of a separate floor panel it will preferably be secured to one or more of the vertical supports, preferably slightly above the very bottom of the supports to minimize fluid seepage in bad weather.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A portable, adjustable tent assembly comprising:

(a) a frame including a first and a second opposite side sections, each of said opposite side sections comprising:

a primary horizontal support member, said primary horizontal support member including a forward end and a rear end, a forward support member, said forward support member including a bottom end and a top end, said top end of said forward support member being hingedly secured at generally said forward end of said primary horizontal support member such that said forward support member is able to pivot between an extended orientation, wherein said forward support member is generally vertically disposed relative to an underlying support surface, and a collapsed orientation, wherein said forward support member is folded into generally collapsed, parallel, relation with said primary horizontal support member, a central support member, said central support member including a bottom end and a top end, said top end of said central support member being hingedly secured at generally said rear end of said primary horizontal support member such that said central support member is able to pivot between an extended orientation, wherein said central support member is generally vertically disposed relative to the underlying support surface, and a collapsed orientation, wherein said central support member is folded into generally collapsed, parallel, relation with said primary horizontal support member, a secondary horizontal support member, said secondary horizontal support including a front end and a rear end, said front end of said secondary horizontal support member being hingedly secured to said rear end of said primary horizontal support member such that said secondary horizontal support member is able to pivot between an extended orientation, wherein said secondary horizontal support member is disposed in a generally horizontal orientation extending away from said rear end of said primary horizontal support member, and a collapsed orientation, wherein said secondary horizontal support member is folded into generally collapsed, parallel, relation with said primary horizontal support member, a rear support member, said rear support member including a bottom end and a top end, said top end of said rear support member being hingedly secured at generally said rear end of said secondary horizontal support member such that said rear support member is able to pivot between an extended orientation, wherein said rear support member is generally vertically disposed relative to the underlying support surface upon said secondary horizontal support being disposed in its extended orientation, and a collapsed orientation, wherein said rear support member is folded into generally collapsed, parallel, relation with said secondary horizontal support member, (b) a primary roof panel, said primary roof panel being constructed of at least one flexible material sheet and being disposed in spanning relation from said primary horizontal support member of said first opposite side section to said primary horizontal support member of said second opposite side section, said primary roof panel defining a primary roof portion upon said first and said second opposite side sections being disposed a spaced apart distance from one another, while still permitting said primary horizontal support members of said first and said second opposite side sections to be collapsible into adjacent, generally abutting relation with one another, (c) a secondary roof panel, said secondary roof panel being constructed of at least one flexible material sheet and being disposed in spanning relation from said secondary horizontal support member of said first opposite side section to said secondary horizontal support member of said second opposite side section, said secondary roof panel defining a secondary roof portion upon said first and said second opposite side sections being disposed said spaced apart distance from one another and said secondary horizontal support members of said first and said second opposite side sections being disposed in said extended orientation, while still permitting said secondary horizontal support members of said first and said second opposite side sections to be collapsible into adjacent, generally abutting relation with one another, (d) a front wall panel, said front wall panel being constructed of at least one flexible material sheet and being disposed to extend between said forward support member of said first opposite side section and said forward support member of said second opposite side section, said front wall panel defining a front wall portion upon said first and said second opposite side sections being disposed said spaced apart distance from one another and said forward support members of said first and said second opposite side sections being disposed in said extended orientation, while still permitting said first and said second opposite side sections to be collapsible into adjacent, generally abutting relation with one another, (e) a rear wall panel, said rear wall panel being constructed of at least one flexible material sheet and being disposed to extend between said rear support member of said first opposite side section and said rear support member of said second opposite side section, said rear wall panel defining a rear wall portion upon said first and said second opposite side sections being disposed said spaced apart distance from one another and said rear support members of said first and said second opposite side sections being disposed in said extended orientation, while still permitting said first and said second opposite side sections to be collapsible into adjacent, generally abutting relation with one another, (f) a first and a second primary side wall panel, said first and said second primary side wall panels being constructed of at least one flexible material sheet and being structured to be disposed between said primary horizontal support member, said forward support member and said central support member of said first and said second opposite side sections so as to define a pair of opposite primary side walls, (g) a first and a second secondary side wall panel, said first and said second secondary side wall panels being constructed of at least one flexible material sheet and being structured to be disposed between said secondary horizontal support member, said central support member and said rear support member of said first and said second opposite side sections so as to define a pair of opposite secondary side walls, and (h) said frame being selectively adjustable between a storage orientation, a partially raised orientation, and a fully raised orientation, said fully raised orientation including said first and said second opposite side sections disposed in said spaced apart distance from one another, said forward and said central support members disposed in said respective extended orientations, wherein said bottom ends of said forward and said central portions supportingly engage the underlying support surface, and said secondary horizontal support member and said rear support member disposed in said respective extended orientations, such that said bottom end of said rear support member supportingly engages the underlying support surface, thereby defining a complete tent enclosure, said partially raised orientation including said first and said second opposite side sections disposed said spaced apart distance from one another, said forward and said central support members disposed in said respective extended orientations, wherein said bottom ends of said forward and said central portions supportingly engage the underlying support surface, and said secondary horizontal support member and said rear support member disposed in said respective collapsed orientations, thereby defining a half tent enclosure, and said storage orientation including said secondary horizontal support members and said forward, said central, and said rear support members disposed in said respective collapsed orientations, and said first and said second opposite side sections disposed in said adjacent, generally abutting relation with one another, thereby defining a substantially compact, transportable unit.

2. A portable, adjustable tent assembly as recited in claim 1 wherein each of said primary horizontal support members includes a normal length at least equivalent to said remaining support members.

3. A portable, adjustable tent assembly as recited in claim 2 wherein said central support members of said first and said second opposite side sections include a telescoping extension segment structured to give said central support members an extended length greater than that of said forward and said rear support members, and thereby provide a cantilevered roof structure.

4. A portable, adjustable tent assembly as recited in claim 1 wherein each of said support members includes a normal length of approximately five feet.

5. A portable, adjustable tent assembly as recited in claim 1 further including a center wall panel, said center wall panel being constructed of at least one flexible material sheet and being disposed to extend between said center support member of said first opposite side section and said center support member of said second opposite side section, and said center wall panel defining a center wall portion upon said first and said second opposite side sections being disposed said spaced apart distance from one another and said center support members of said first and said second opposite side sections being disposed in said extended orientation, while still permitting said first and said second opposite side sections to be collapsible into adjacent, generally abutting relation with one another, said center wall portion defining an interior divider in said fully raised orientation, and an exterior wall in said partially raised orientation.

6. A portable, adjustable tent assembly as recited in claim 5 wherein said center wall panel includes a resealable seam defined therein and structured to permit passage of a user therethrough.

7. A portable, adjustable tent assembly as recited in claim 5 wherein said center wall panel includes at least one window defined therein.

8. A portable, adjustable tent assembly as recited in claim 1 wherein said front wall panel includes a resealable seam defined therein and structured to permit passage of a user therethrough.

9. A portable, adjustable tent assembly as recited in claim 1 wherein said front wall panel includes at least one window defined therein.

10. A portable, adjustable tent assembly as recited in claim 1 wherein said rear wall panel includes a resealable seam defined therein and structured to permit passage of a user therethrough.

11. A portable, adjustable tent assembly as recited in claim 1 wherein said rear wall panel includes at least one window defined therein.

12. A portable, adjustable tent assembly as recited in claim 1 wherein said primary side wall panels include at least one window defined therein.

13. A portable, adjustable tent assembly as recited in claim 1 wherein said primary side wall panels retractably extend from said primary horizontal supports and are removeably fastenable to said forward and said central support members.

14. A portable, adjustable tent assembly as recited in claim 1 wherein said secondary side wall panels include at least one window defined therein.

15. A portable, adjustable tent assembly as recited in claim 1 wherein said secondary side wall panels retractably extend from said secondary horizontal supports and are removeably fastenable to said rear and said central support members.

16. A portable, adjustable tent assembly as recited in claim 1 wherein both said forward and said central support members collapse into generally abutting engagement with a bottom surface of said primary horizontal support members upon being in said collapsed orientations.

17. A portable, adjustable tent assembly as recited in claim 1 wherein said rear support members collapse into generally abutting engagement with a bottom surface of said secondary horizontal support members upon being in said collapsed orientation.

18. A portable, adjustable tent assembly as recited in claim 1 wherein said primary roof panel and said secondary roof panel are integrally formed with one another.

19. A portable, adjustable tent assembly as recited in claim 1 further including a central spanning support member extending between said first and said second opposite side sections, at generally said rear ends of said primary horizontal supports, and structured to maintain said first and said second opposite side sections in said spaced apart relation from one another.

20. A portable, adjustable tent assembly as recited in claim 19 wherein said central spanning support member includes a pair of central span sections, each of said central span sections being hingedly secured to a corresponding one of said primary horizontal support members and being moveable between an extended orientation, wherein said central span sections are secured with one another so as to define said central spanning support, and a collapsed orientation.

21. A portable, adjustable tent assembly as recited in claim 19 wherein said central spanning support includes a single telescoping member hingedly secured to one of said primary horizontal supports and including an extended orientation, wherein a length of said single telescoping member is increased so as to extend into secure spanning engagement with an opposite one of said primary horizontal support members, and a collapsed, retracted orientation.

22. A portable, adjustable tent assembly as recited in claim 1 further including a forward spanning support member extending between said first and said second opposite side sections, at generally said front ends of said primary horizontal supports, and structured to maintain said first and said second opposite side sections in said spaced apart relation from one another.

23. A portable, adjustable tent assembly as recited in claim 22 wherein said forward spanning support includes a pair of forward span sections, each of said forward span sections being pivotally secured to a corresponding one of said forward support members and being moveable between an extended orientation, wherein said forward span sections are secured with one another so as to define said forward spanning support, and a collapsed orientation.

24. A portable, adjustable tent assembly as recited in claim 22 wherein said forward spanning support includes a single telescoping member pivotally secured to one of said forward support members and including an extended orientation, wherein a length of said single telescoping member is increased so as to extend into secure spanning engagement with an opposite one of said forward support members, and a collapsed, retracted orientation.

25. A portable, adjustable tent assembly as recited in claim 1 further including a rear spanning support member extending between said first and said second opposite side sections, at generally said rear ends of said secondary horizontal supports and structured to maintain said first and said second opposite side sections in said spaced apart relation from one another.

26. A portable, adjustable tent assembly as recited in claim 25 wherein said rear spanning support includes a pair of rear span sections, each of said rear span sections being pivotally secured to a corresponding one of said rear support members and being moveable between an extended orientation, wherein said rear span sections are secured with one another so as to define said rear spanning support, and a collapsed orientation.

27. A portable, adjustable tent assembly as recited in claim 25 wherein said rear spanning support includes a single telescoping member pivotally secured to one of said rear support members and including an extended orientation, wherein a length of said single telescoping member is increased so as to extend into secure spanning engagement with an opposite one of said rear support members, and a collapsed, retracted orientation.

28. A portable, adjustable tent assembly as recited in claim 1 further including a carry case structured to contain said first and said second opposite side sections in said storage orientation therein for facilitated transport.

* * * * *